United States Patent [19]

Barnes

[11] 4,175,661

[45] Nov. 27, 1979

[54] STACKABLE LIGHT REFRACTOR

[75] Inventor: Jocelyn T. Barnes, Charlevoix, Mich.

[73] Assignee: Lexalite International Corporation, Charlevoix, Mich.

[21] Appl. No.: 937,160

[22] Filed: Aug. 28, 1978

[51] Int. Cl.[2] ..... B65D 21/02; F21V 3/00

[52] U.S. Cl. ..... 206/519; 362/355; 362/363

[58] Field of Search ..... 206/515, 519, 520; 362/355, 361, 363

[56] References Cited

U.S. PATENT DOCUMENTS

| | | | |
|---|---|---|---|
| 2,773,172 | 12/1956 | Pennow | 362/363 |
| 3,007,039 | 10/1961 | Dvorak | 362/355 |
| 3,123,273 | 3/1964 | Miller | 206/520 |
| 3,139,213 | 6/1964 | Edwards | 206/519 |
| 3,288,340 | 11/1966 | Shapiro | 206/519 |

*Primary Examiner*—George E. Lowrance

*Attorney, Agent, or Firm*—Mason, Kolehmainen, Rathburn & Wyss

[57] ABSTRACT

A stackable light refractor comprises an annular hollow tubular shaped element of light transmissive material having a large end and a pair of spaced apart inner and outer surfaces tapering toward a small end. The outer surface of the refractor includes a plurality of annular outwardly projecting ridges of prism shaped cross-section spaced between the larger and smaller ends. One of the ridges, spaced a distance closer to the larger end than the smaller end is substantially larger than the adjacent ridges and extends outwardly of the adjacent ridges on either side. The refractor is provided with a stacking element adjacent the larger end including radially inwardly extending elements adapted to engage the large ridge on an adjacent stacked refractor so that a plurality of refractors may be arranged in a stack for convenient shipment and the like without wedging between the refractors and without requiring additional spacers or other packing materials for preventing the wedging of the refractors together during shipment.

15 Claims, 4 Drawing Figures

FIG. 1
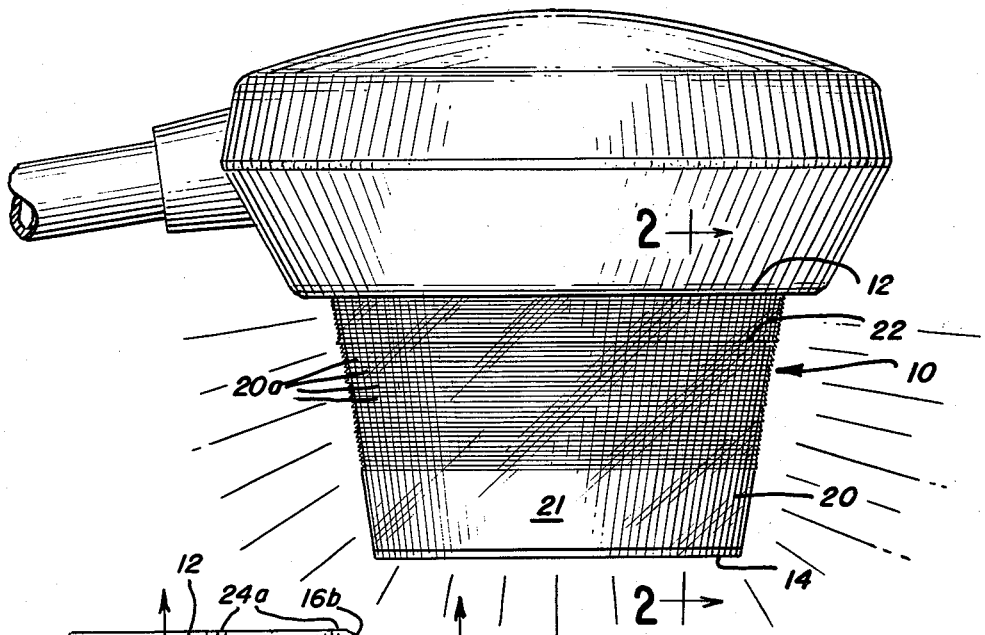
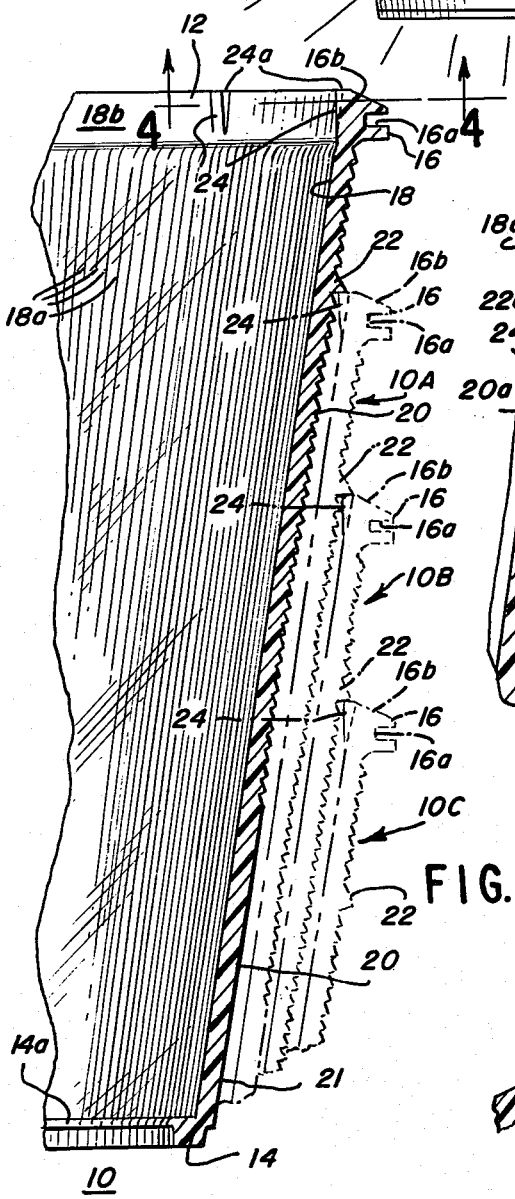
FIG. 2
FIG. 3
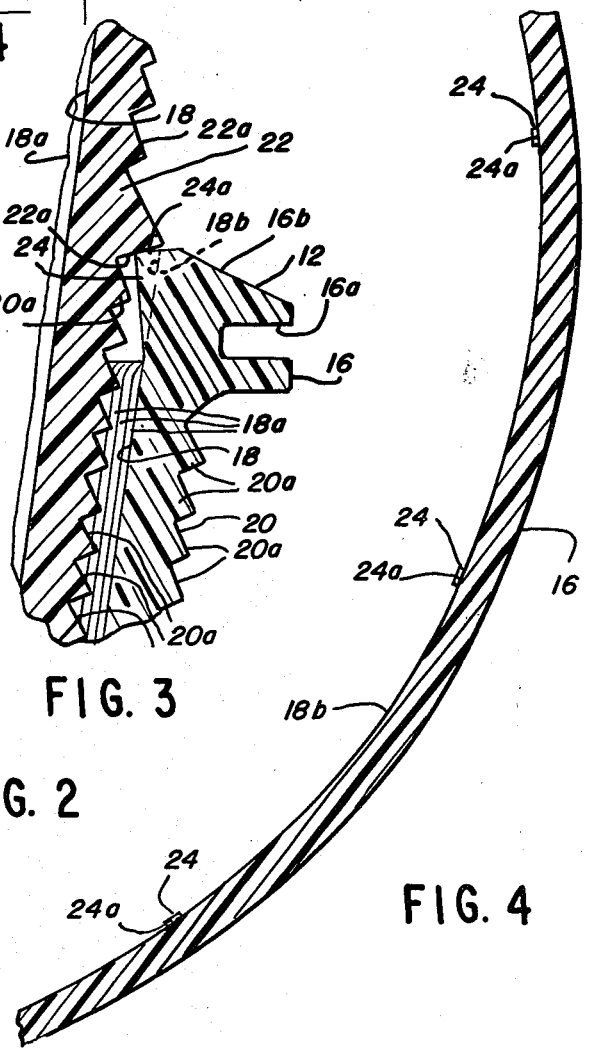
FIG. 4

STACKABLE LIGHT REFRACTOR

BACKGROUND OF THE INVENTION

1. Field of the Invention

The present invention relates to light refractors and more particularly those used with outdoor luminaires and other lighting fixtures. The refractors are stackable or nestable together in numbers for convenient shipment without requiring any spacer blocks or other packing devices commonly used to prevent nested objects such as refractors from wedging together when subjected to rough handling or the like during shipment.

2. Description of the Prior Art

It has long been desirous when shipping numbers of light refractors formed of glass or plastic materials used with indoor and outdoor lighting fixtures and lamps to provide means for supporting and separating the units in order to prevent breakage. In addition, when units are nested or stacked, wedging together of the units often occurred and ultimately resulted in breakage of the refractors when attempts were made to separate a pair of units tightly wedged together.

U.S. Pat. No. 959,489 discloses a system for packing fragile articles such as glass lamp shades and this system requires the use of a separate central column and a plurality of stacking-spacers.

U.S. Pat. No. 1,012,533 discloses a stackable lamp guard made up of wire.

U.S. Pat. No. 1,146,515 discloses a packing or shipping box in which lamp shades are arranged in a stack and corrugated paper board spacers are provided to prevent breakage and to prevent contact between the adjacent lamp shades in the stack.

U.S. Pat. No. 2,462,497 discloses an ice cream cup of novel design intended for packing together in a stack or nested condition.

U.S. Pat. No. 2,780,243 discloses a novel plastic valve cap which can be assembled with others in a stacking arrangement.

U.S. Pat No. 3,122,296 discloses nestable cups.

U.S. Pat. No. 3,539,552 discloses a stackable thin wall tub, and U.S. Pat. No. 3,949,877 discloses nestable drums.

None of the aforementioned U.S. Patents disclose a nestable or stackable annular refractor which requires no separate spacing elements or packing rings to provide security against damage and inadvertent wedging.

Accordingly, it is an object of the present invention to provide a new and improved nestable or stackable light refractor and more particularly a light refractor of the character described which does not require separate spacers or the like to prevent wedging or binding engagement between the refractors when arranged in a stack or nest for shipment.

It is an object of the present invention to provide a new and improved light refractor having annular prismatic rings on an outer surface thereof with one of the rings being useful in preventing wedging engagement between the rings on one refractor and the inner surface of an adjacent refractor to be nested therewith.

It is an object of the present invention to provide a novel light refractor of the character described in which one of the outer prismatic rings serves a dual function of refracting the light as desired and provides support means for preventing any wedging engagement between refractors when placed coaxially together in a stack or nested arrangement.

Still another object of the present invention is to provide a new and improved annular hollow refractor for use with lighting fixtures and the like which provides a novel system for supporting the refractors in multiples stacked together to conserve space.

Yet another object of the present invention is to provide a new and improved annular hollow refractor which has novel means for preventing any wedging or binding engagement between the surfaces of adjacent refractors placed in a nested or stacked arrangement.

Still another object of the present invention is to provide a new and improved light refractor of the character described which may be conveniently arranged in nested together stacks in relatively large numbers for conserving space for shipment and without requiring any separators or other spacing devices to prevent contact between adjacent units.

Another object of the present invention is to provide a new and improved nestable or stackable refractor of the character described which includes means for maintaining a stack of several refractors in end to end coaxial relationship.

BRIEF SUMMARY OF THE INVENTION

The foregoing and other objects and advantages of the present invention are accomplished in a new and improved stackable or nestable light refractor adapted for use with lighting fixtures such as outdoor luminaires and the like. The light refractor comprises an annular, hollow, tubular shaped element of light transmitting material having a large dimension upper end and a pair of spaced apart inner and outer surfaces tapering downwardly toward a smaller, lower end. The outer surface is formed with a plurality of annular, outwardly projecting ridges or rings of prism shaped, transverse, cross-section for deflecting the light outwardly and downwardly in a diffused manner. One of the prism shaped rings, spaced closer to the larger end of the refractor, is larger than the other adjacent rings and projects outwardly beyond the others in order to provide a stacking support surface for engagement against an adjacent refractor stacked in coaxial alignment therewith. Each refractor includes an internal stacking element on the inside adjacent the larger end adapted to engage the large ring of an adjacent stacked refractor and maintain the refractors in coaxially aligned, stacked relation without any wedging between the inside surface of one refractor and the outer annular prism shaped rings on the adjacent refractor in the stack. A number of refractors can thus be stacked together and maintained in coaxially aligned nested relation without requiring any spacing devices or other paraphernalia commonly used for preventing breakage or wedging engagement between adjacent refractors. The large ridges or rings of the refractors provide a dual function in deflecting the light rays and in providing one stacking element for cooperation with the inside stacking elements of an adjacent refractor in nested relation therewith.

BRIEF DESCRIPTION OF THE DRAWINGS

For a better understanding of the present invention, reference should be had to the following detailed description taken in conjunction with the drawings, in which:

FIG. 1 is a side elevational view of an outdoor luminaire or typical lighting fixture employing a new and improved stackable light refractor constructed in accordance with the features of the present invention;

FIG. 2 is a fragmentary, vertical, cross-sectional view taken substantially along lines 2—2 of FIG. 1 but illustrating additional light refractors arranged in a nested stacked relation therewith shown in dotted lines;

FIG. 3 is a greatly enlarged, fragmentary, vertical cross-sectional view showing the stacked nested relationship between adjacent pairs of refractors in a stack; and FIG. 4 is a fragmentary, transverse, cross-sectional view taken substantially along lines 4—4 of FIG. 2.

DESCRIPTION OF THE PREFERRED EMBODIMENT

Referring now more particularly to the drawings, in FIG. 1 is illustrated a typical luminaire or lighting fixture installation, with which a stackable light refractor 10 constructed in accordance with the features of the present invention is used. The light refractor 10 is generally frustroconical in shape and includes a large diameter, upper end portion 12 and tapers inwardly and downwardly toward a smaller diameter lower end portion 14. As best illustrated in FIGS. 2 and 3, the upper end portion of the refractor 10 includes an outwardly extending annular ridge 16 having an inwardly extending annular groove **16*a* therein and an upper conically beveled surface 16*b* for use in securing the refractor in place in a lighting fixture around a light source (not shown) mounted at the center of the refractor. In accordance with the present invention, the refractor includes a generally frustroconical internal surface 18 formed with a plurality of generally upwardly extending, circumferentially spaced ribs or ridges 18*a* of triangular shaped prismatic, horizontal cross-section. These vertical ridges diffuse the light rays which radiate outwardly from the central light source. The vertical, internal ridges 18*a* extend substantially the entire vertical dimension of the refractor between an inwardly extending stiffening lip 14*a* at the minimum diameter lower end portion 14 and a narrow band or cylindrically shaped, smooth surface area 18*b* adjacent the maximum diameter upper end portion 12** of the refractor.

The refractor includes a generally frustroconically shaped outer surface 20 generally parallel of the internal surface 18 and formed to include a plurality of horizontally spaced, annular ridges or rings **20*a* of prism shaped, generally triangular, cross-section. These outer rings are adapted to deflect the light rays outwardly and downwardly from the central light source within the refractor as best shown in FIG. 1**. Each annular prism ring has an outwardly and downwardly sloping, frustroconical, upper surface intersecting at an outer apex and an outwardly extending generally horizontal or slightly upwardly sloping, lower surface. These rings are effective to deflect and diffuse the radial light rays outwardly and downwardly in an efficient manner.

As shown in FIGS. 1 and 2, the rings **20*a* are concentrated on approximately the upper two-thirds of the outer surface area of the refractor and approximately a lower one-third of the outer surface 20 is relatively smooth as indicated by the reference numeral 21**.

In accordance with the present invention, a selected one of the annular outer prism rings indicated by the reference numeral 22 is made larger than the other prism rings **20*a* and is of a similar but somewhat larger cross-sectional profile. This stop ring serves an additional function of mechanically separating the individual refractors 10 from one another when they are placed in coaxial alignment in a nested stack as illustrated in FIG. 2. The large annular stop ring 22 is positioned approximately one-sixth of the vertical height of the refractor downwardly of the large diameter, upper end portion 12 and includes a substantially horizontal or slightly upwardly sloping lower annular stop surface 22*a* (FIG. 3) facing downwardly and projecting outwardly beyond the outer apexes of the adjacent upper and lower normal size prism rings 20*a*** above and below the stop ring.

The annular stop surface **22*a* is adapted to bear against the upper, generally horizontal stop surfaces 24*a* at the upper ends of a plurality of circumferentially spaced apart, radially inwardly extending, stacking lugs 24 provided on the internal surface 18 of the refractor at radially spaced locations on the smooth surfaced band 18*b*. When a number of refractors 10 are stacked together in nested relation in coaxial alignment as shown schematically in FIGS. 2 and 3, the upwardly facing horizontal stop surfaces 24*a* on the internal lugs 24 of the lower refractors 10C, 10B, 10A, etc. bear against the downwardly facing stop surfaces 22*a* of the stop rings 22 on the respective, adjacent next upper refractors 10B, 10A and 10 in the stack. The engagement between the end 24*a* of the inwardly extending lugs 24 and the stop surfaces 22*a* of the stop rings 22** prevents paris of the refractors in the stack from becoming wedged together. In addition, this engagement provides for a desired, end to end spacing of the several refractors of a nested stack and eliminates the need for spacers, packing rings and the like. The nested arrangement as described saves space in a shipping carton and because a plurality of circumferentially spaced, relatively small size lugs are provided, any forces or stresses transmitted between adjacent refractors in a stack are distributed on an equilateral basis resulting in a substantially uniform force loading carried around the circumference or periphery of the refractors. This even distribution of end loads reduces the chance of breakage should rough handling be encountered and when the refractors are made out of a relatively fragile material such as glass, breakage is seldom encountered. With stronger materials such as the tough and strong acrylic resins and the polycarbonate resins, the chance of breakage occurring during shipment is reduced even further.

The engagement between the stop ring surfaces **22*a* on the outer stop rings 22 and the adjacent upper ends 24*a* of the internal stacking lugs 24 positively prevents locking or wedging engagement between the inside and outside surfaces of adjacent refractors in a nested stack as shown in FIG. 2 and in addition, maintains the refractors in coaxial alignment. The ends 24*a* of the internal stacking lugs 24 are on common level with the large diameter end surface of the refractor and the lugs are dimensioned so that their inwardly facing edges lie on a common circle with a diameter less than the outer diameter of the apex of the large annular stop ring 22 of the refractor. This arrangement insures positive engagement between the inner lugs 24 and the stop ring surface 22*a*** when the refractors are nested together.

Preferably, the stop ring 22 is spaced in the upper quarter of the refractor body towards the larger diameter end 12 and the refractor is tapered with a ratio between the small end and the larger end of approximately five-sixths to provide a convenient and stable stackable arrangement for the refractors. The lugs 24 are equilaterally, radially spaced around the inner surface band 18*b* of the refractor and a convenient number of lugs are provided. A commercial embodiment of the invention includes a total of twelve lugs which are spaced equilaterally apart and are integrally molded with the body of the refractor. The outer diameter of the apex of the large stop rings 22 is approximately equal to or just slightly larger than the maximum diameter of the inside surface 18 of the refractor taken at the upper end 12. This insures self aligning guidance into seating engagement between the upper end surfaces 24*a* of the stacking lugs 24 and the annular seating surface 22*a* of the stop ring 22 of the next adjacent refractor in the stack.

From the foregoing it will be noted that the annular stackable refractors 10 constructed in accordance with the present invention can be conveniently stacked in coaxial nested relation as illustrated, in any desired quantity such as six or twelve units and a stack of the refractors can be easily placed in a shipping box or carton having an internal cross-sectional dimension slightly greater than the outer diameter of the upper end ring 16. No other spacer elements or packing devices are required and the stack of nested together refractors may thus be conveniently shipped in cartons and the like with little danger of breakage and with no chance of the refractors becoming tightly wedged together even though rough handling may be encountered. The annular stop rings 22 of the refractors 10 serve in a dual capacity as both a prismatic light refractor for the radial light rays eminating from a light source on the central axis of the refractor and in providing a convenient stop surface and device cooperating with the lugs 24 for insuring a coaxially aligned, nested but non-wedging engagement between adjacent refractors in a nested stack.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A light refractor comprising:

an annular, hollow tubular shaped element of light transmissive material having a large end and a pair of spaced apart inner and outer surfaces tapering toward a small end;

said outer surface including a plurality of annular, outwardly projecting ridges of prism shaped transverse cross-section spaced between said larger and smaller ends for directing light rays from a light source centrally disposed in said annular element to pass outwardly therethrough;

one of said prism shaped ridges spaced a distance closer to said larger end than said smaller end projecting outwardly a substantially greater distance than the other ridges of prism shaped cross-section; and a stacking element adjacent said larger end of said refractor extending radially inwardly of said inner surface and remote from said ridges for stacking engagement with a stop surface on said one prism shaped ridge of an adjacent refractor in coaxial stacked relation therewith for preventing wedging engagement between the ridges of said adjacent refractor and the inside surface of said refractor.

2. The refractor claim 1 wherein said inner surface of said refractor includes a plurality of inwardly projecting, circumferentially spaced ridges of prism shaped cross-section extending between said larger and smaller ends.

3. The refractor of claim 1 wherein said ridges form a plurality of alternately spaced apexes and valleys on said outer surface and said apex of said one ridge projects outwardly beyond adjacent apexes on either side.

4. The refractor of claim 3 wherein said stacking element includes an inwardly facing edge lying on a common circle of a diameter less than the outer diameter of the apex of said one ridge.

5. The refractor of claim 4 wherein the diameter of said common circle is greater than the outer diameter of the apex of a ridge next adjacent said one ridge toward said smaller end of said refractor.

6. The refractor of claim 1 wherein said one ridge includes a planar surface substantially parallel of said ends of said refractor.

7. The refractor of claim 6 wherein said one ridge includes a frustro conical surface intersecting said planar surface at said apex end sloping inwardly thereof toward said larger end.

8. The refractor of claim 6 wherein said stacking element includes a ridge engaging surface substantially parallel of said planar surface of said one ridge.

9. The refractor of claim 1 wherein the spacing between said one ridge and said larger end is less than one quarter of the distance between said larger and smaller ends.

10. The refractor of claim 1 wherein said smaller end has a diameter of approximately 5/6ths of the diameter of said larger end.

11. The refractor of claim 1 wherein said stacking element includes a plurality of radially spaced apart radially inwardly directed lugs having ridge engageable surfaces thereon.

12. The refractor of claim 11 wherein said surfaces of said lugs are aligned with an end surface of said refractor at said large end.

13. The refractor of claim 1 wherein said hollow tubular element is frustro-conical in shape.

14. The refractor of claim 13 wherein said stacking element includes a plurality of circumferentially spaced apart radially inwardly directed lugs adjacent said large end spaced equilaterally around said inner surface.

15. The refractor of claim 13 wherein said lugs formed with a stacking surface coextensive with an end surface of said large end.

* * * * *